US005913393A

United States Patent [19]

Shaltry et al.

[11] Patent Number: 5,913,393

[45] Date of Patent: Jun. 22, 1999

[54] DEVICE FOR METERING FIBERS

[75] Inventors: Michael J. Shaltry, Charlotte, N.C.; Charles H. Hurst, Lugoff, S.C.

[73] Assignee: Camelot Superabsorbents Limited, Calgary, Canada

[21] Appl. No.: 08/598,576

[22] Filed: Feb. 12, 1996

[51] Int. Cl.[6] ..... D01G 23/04

[52] U.S. Cl. ..... 19/97.5; 19/105

[58] Field of Search ..... 19/97.5, 105

[56] References Cited

U.S. PATENT DOCUMENTS

| | | | |
|---|---|---|---|
| 1,074,468 | 9/1913 | Ryan | 19/97.5 X |
| 3,579,744 | 5/1971 | Menzies, Jr. | 19/97.5 |
| 3,889,318 | 6/1975 | Leinek et al. | 19/105 |
| 4,133,455 | 1/1979 | Moser | 19/97.5 X |
| 4,510,647 | 4/1985 | Keller et al. | 19/105 |
| 4,528,723 | 7/1985 | Hergeth et al. | 19/97.5 X |
| 4,823,440 | 4/1989 | Pinto | 19/105 |
| 4,968,188 | 11/1990 | Lucassen | 19/105 X |

*Primary Examiner*—John J. Calvert
*Assistant Examiner*—Larry D. Worrell, Jr.
*Attorney, Agent, or Firm*—Hodgson, Russ, Andrews, Woods & Goodyear LLP

[57] ABSTRACT

A device for handling fibers is described. The device comprises:

an apparatus for forming a column of fibers of uniform density;

an apparatus for metering fibers from the column;

conveying apparatus, the conveying apparatus serving to convey the metered fibers from the metering apparatus;

a comb device, the comb device being spaced from the metering apparatus and in association with the conveying apparatus;

a removing device, the removing device being located such that it removes the fibers from the comb device and introduces the fibers into a device for transporting the fibers from the fiber handling device.

19 Claims, 1 Drawing Sheet

DEVICE FOR METERING FIBERS

Figure 1:
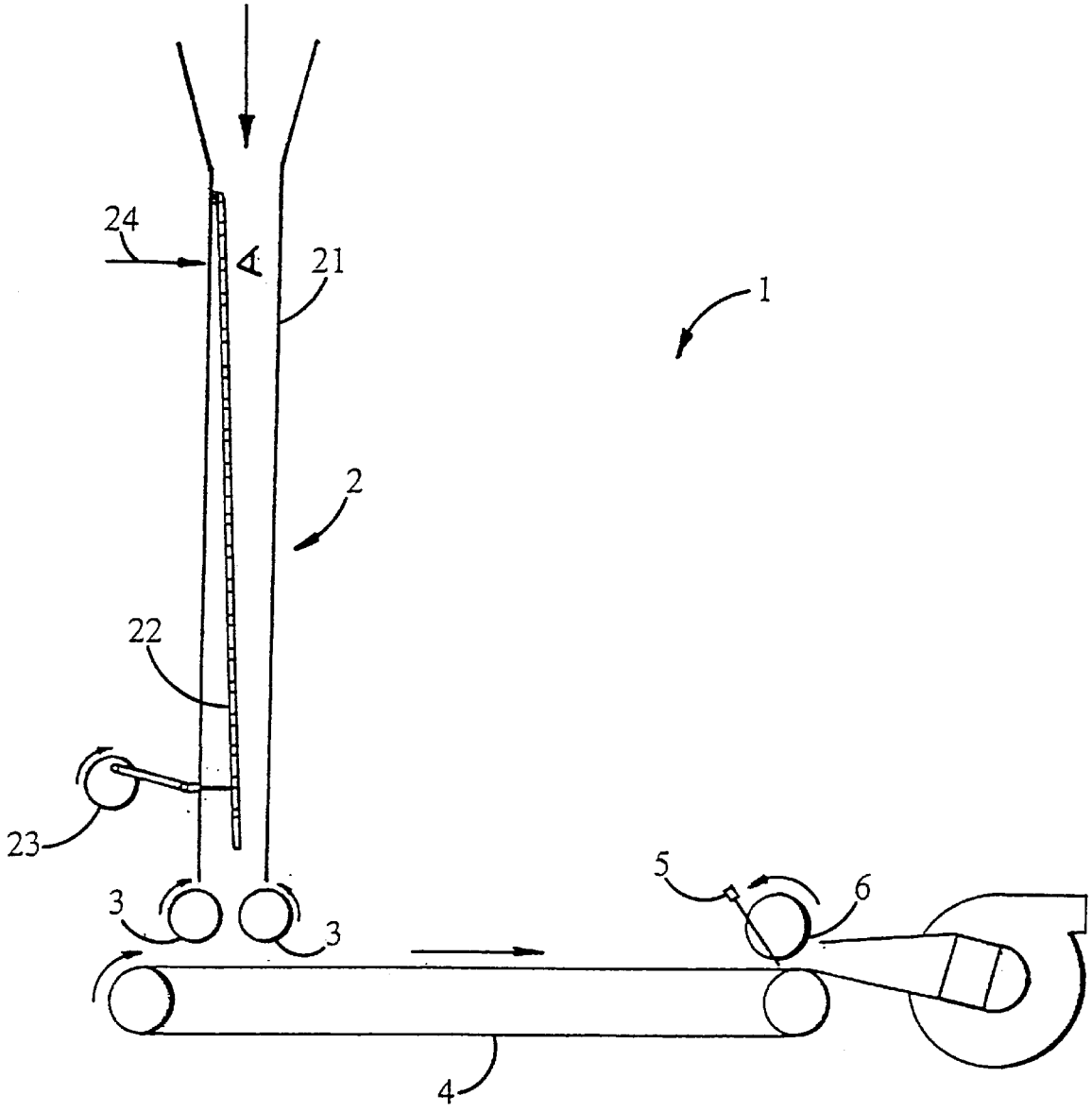

The present invention relates to a device for handling fibers.

The problems associated with handling fibers have to be addressed in a wide range of industries, particularly those in which the end product utilises a high volume of non-woven fibers. Such industries include the paper and textile industries and those involved with the production of sanitary articles such as diapers, sanitary napkins, tampons, incontinence products, towels, tissues and other products for the absorption of significant quantities of fluids including body exudates and other aqueous compositions.

The problems associated with handling fibers include a tendency for the fibers to become mutually entangled and to cling to each other and to machinery. The feature of the fibers clinging to each other and to machinery may occur for a variety of reasons and may be due to a build-up of electrostatic forces or tackiness due to moisture absorbed by the fibers from the atmosphere. Further, where the fibers are fragile, excess handling, or strong handling, may result in the fibers being damaged.

The problems associated with handling fibers may be exacerbated where some, or all, of the fibers being handled are water-absorbent fibers, in particular those known as superabsorbent fibers. Because of the inherent hygroscopicity of these superabsorbent fibers, the problem of the fibers becoming mutually entangled or clinging together or to machinery may be particularly acute.

In conventional fiber handling devices, vibrations, such as those produced by a vibrating plate, are used to provide a column of fibers of uniform density. This column of fibers is then passed to a fiber metering device. The metering device may comprise two adjacent rollers located at the base of the column. These rollers, which generally rotate in opposite directions, meter the fiber down-stream use. The rollers may be fluted or grooved as required by the application.

Wire wound rollers may be located beneath the metering rollers. These rollers serve to separate the fibers before they are passed to a conventional air forming machine.

One known fiber handling device is described in our co-pending application which was filed in the UK on Feb. 8, 1995 and accorded the number 9502440.2. This application is incorporated herein by reference. In the handling device of GB application number 9502440.2 a device for metering fibers is described which comprises; a hopper suitable for holding fibers and having at its lower end a mouth with a slit, one wall of the slit being provided by the circumferential surface of a rotatable feed roll for urging fibers through the slit into a receiving zone; and counter-rotatable means for removing fibers from the surface of the feed roll in the receiving zone.

When the feed rate is desired to be slow or the fiber length is short or when both the feed rate is slow and the fiber length is short, the flow of fibers to the air forming machine may become uneven. Without wishing to be bound by any theory it is believed that this is due to the formation of tufts when the fibers are contacted by the wire wound rollers.

We have now discovered an alternative fiber handling device which overcomes the problems associated with conventional fiber handling devices.

According to the present invention, there is provided a device for handling fibers comprising:

means for forming a column of fibers of uniform density;

means for metering fibers from said column;

conveying means, said conveying means serving in use to convey the metered fibers from the metering means;

comb means, said comb means being spaced from the metering means and in association with the conveying means;

removing means, said removing means being located such that in use it may remove the fibers from the comb means and introduce the fibers into means for transporting the fibers from the fiber handling device.

Thus, in use, fibers are introduced into the means for forming the column, the fibers at the base of the column are then metered by the means for metering the fibers onto the conveying means. The comb means then contacts the fibers and arranges them in the manner required. During this arrangement fibers may be caught in the comb means. The removing means removes any caught fibers and introduces them into thee means for transporting the fibers from the fiber handling device. Thus by "removes the fibers from the comb", we mean that the fibers are removed from within the teeth of the comb if they are so caught and/or removed from the vicinity of the comb.

In addition to overcoming the problems associated with the handling of fibers by known devices as described above, the handling device of the present invention is gentler on the fibers than known devices and thus, damage to the fibers is reduced. A still further advantage of the device of the present invention is that the fibers are metered in a uniform manner making down-stream processing more effective.

The device may be used to meter both crimped and uncrimped fibers. In addition, the device in accordance with the present invention is simpler to manufacture and operate, lower in cost to produce and operate than known devices and generates less waste than previous arrangements.

By "column" we mean that the fibers are arranged in a stack. The stack need not be cylindrical in shape, for example, an inverted pyramidal shape may be used. Similarly, it is not necessary that the column of fibers should be arranged to be of vertical configuration. However, a substantially cylindrical column of substantially vertical orientation is preferred.

The column may be formed by introducing the fibers into a hopper or a chute. The hopper or the chute may be equipped with vibrating means. The vibrating means may comprise a plate within the hopper or chute which is caused to vibrate. In one alternative embodiment, the hopper or chute itself may be caused to vibrate. In a preferred embodiment of the present invention, the hopper or chute includes a plate which may be moved from a first position to a second position, such plates are commonly referred to as "spanker" plates. The frequency of movement from the first to the second position may be of the order of 1–5 $s^{-1}$ or more, preferably 1–2 $s^{-1}$. The spanker plate may be perforated and may have up to 75%, preferably about 50%, open area.

The hopper may have the configuration of the hopper of GB application no 9502440.2. That is to say the hopper may have at its lower end a mouth with a slit.

The means for metering fibers from said column may comprise two rollers located adjacent to one another at the opening at the base of the means for forming the fibers into a column. The rollers rotate in opposite directions and are arranged such that the movement of both rollers at their closest point is away from the base of the column of fibers. The rollers are preferably of the same size and preferably rotate at the same speed. The surface of the rollers are preferably fluted metering rollers. That is to say, the surface of the rollers may be provided with teeth, which are preferably adjustable. The selection of rounded teeth serves to minimize any damage to the fibers associated with passing through the metering rollers.

The combination of the means for forming the column of fibers and the metering means may together be formed by the device for metering fibers of GB 9502440.2.

Once the fibers have passed through the metering means they pass to the conveying means. Whilst the conveying means is preferably a conveyor belt, it will be understood that other conveying means, such as a discontinuous conveying means, an air stream or a stream of water may also be utilised if appropriate for the nature of the fiber. The speed of the conveying means will be proportional to the speed of the metering means, for example, the speed of rotation of the metering rollers.

Without wishing to be bound by any theory it is believed that the presence of the conveying means in the fiber handling device serves to form a this layers of fibers which is advantageous in the subsequent handling of the fibers.

Removed from the metering means and in association with the conveying means is the comb means. The comb means is preferably a comb. However, any means which when contacted with the fibers acts to separate and substantially line up the fibers may be used. The comb means is preferably stationary and angled to the conveying means such that the movement of the conveying means relative to the comb means enables the comb means to function. In a particularly preferred embodiment the length of the comb is equivalent to the width of the conveying means, the diameter of the teeth is about 0.6 inch and the teeth are mutually spaced by 3/16 inch. In another preferred embodiment, the diameter of the teeth is 1/8 inch and are mutually spaced by 1/4 inch.

As the comb means acts on the fibers, fibers may become enmeshed in the comb means. A removing means is therefore located adjacent to and in contact with the comb means such that the removing means removes the fibers from the comb means that introduces them into the means for transporting the fibers from the fiber handling device. The removing means is preferably a brush, more preferably a rotary brush. The rotary brush may rotate such that its movement on the side adjacent to the conveyor means is travelling in the same direction as the conveyor means. In one alternative embodiment the brush means is an air stream.

The means for transporting the fibers from the fiber handling device is preferably an air transporting means.

According to a further aspect of the present invention there is provided the use of the device of the above mentioned first aspect to handle superabsorbent fibers.

A preferred embodiment of the present invention will now be described with reference to the accompanying drawings in which:

The FIGURE is a schematic cross-sectional diagram of a device according to the present invention in association with a metering device and an air transportation means.

As can be seen from FIG. 1, the device of the present invention 1 comprises a means 2 for forming a column of fibers comprising a chute 21 and a spanker plate 22 which is preferably fixed at its highest point to the wall of the chute. The spanker plate is a perforated sheet having a 50%open space. A reciprocating motor 23 moves the lower end of the plate from a first position in which it is adjacent to the wall of the chute to a second position in which it is removed from the wall of the chute. A photosensor is located at the upper end of the chute to detect the height of the column of fibers.

Located at the mouth of the chute are a pair of metering rollers 3. These rollers rotate in opposite directions at identical speeds and meter the fibers in a controlled manner onto the conveyor belt 4. The speed of the conveyor belt is chosen such that it is proportional to the speed of rotation of the metering rollers.

Located at the end of the conveyor belt remote from the metering rollers is a comb 5 angled to the conveyor. Adjacent to the comb and in contact therewith is a brush roll.

What we claim is:

1. A device for metering fibers for downstream processing comprising:

means for forming a column of fibers of uniform density;

means for metering fibers from said column;

conveying means, said conveying means serving in use to convey the metered fibers from the metering means;

comb means, said comb means being spaced from the metering means and in association with the conveying means, said comb means separating and substantially lining up the fibers;

removing means, said removing means being located such that in use it may remove fibers caught in the comb means and introduce the fibers into means for transporting the fibers from the device for metering fibers.

2. A device for metering fibers according to claim 1 wherein the means for forming a column comprises a hopper.

3. A device for metering fibers according to claim 2 wherein the hopper is provided with vibrating means.

4. A device for metering fibers according to claim 1 wherein the means for forming a column comprises a chute.

5. A device for metering fibers according to claim 4 wherein the chute is provided with a plate which may be moved from a first position to a second position.

6. A device for metering fibers according to claim 1 wherein the means for metering fibers from said column comprises two rollers located adjacent to one another at the opening at the base of the means for forming the fibers into a column.

7. A device for metering fibers according to claim 6 wherein the surface of the rollers is provided with intermeshing gears having rounded teeth.

8. A device for metering fibers according to claim 1 wherein the conveying means is a conveyor belt.

9. A device for metering fibers according to claim 1 wherein the comb means is comb.

10. A device for metering fibers according to claim 1 wherein the removing means is a rotary brush.

11. A device for metering fibers according to claim 1 wherein the means for transporting the fibers from the fiber handling device is an air transporting means.

12. A device for metering fibers for downstream processing comprising:

means for forming a column of fibers of uniform density comprising a hopper provided with vibrating means;

means for metering fibers from said column comprising two rollers located adjacent to one another at the opening at the base of the means for forming the fibers into a column, the surface of the rollers being provided with intermeshing gears having rounded teeth;

a conveyor belt, said conveyor belt serving in use to convey the metered fibers from the metering means;

a comb, said comb being spaced from the metering means and being located in association with the conveyor belt, said comb separating and substantially lining up the fibers;

a rotary brush, said rotary brush being located such that in use it may remove fibers caught in the comb means and introduce the fibers into means for transporting the fibers from the device for metering fibers.

13. A device for metering fibers for downstream processing comprising:

means for forming a column of fibers of uniform density comprising a chute provided with a spanker plate;

means for metering fibers from said column comprising two rollers located adjacent to one another a the opening at the base of the means for forming the fibers into a column, the surface of the rollers being provided with intermeshing gears having rounded teeth;

a conveyor belt, said conveyor belt serving in use to convey the metered fibers from the metering means;

a comb, said comb being spaced from the metering means and being located in association with the conveyor belt, said comb separating and substantially lining up the fibers;

a rotary brush, said rotary brush being located such that in use it may remove fibers caught in the comb means and introduce the fibers into means for transporting the fibers from the device for metering fibers.

14. The device of claim 1 wherein at least a portion of the fibers are superabsorbent fibers.

15. The device of claim 12 wherein at least a portion of the fibers are superabsorbent fibers.

16. The device of claim 13 wherein at least a portion of the fibers are superabsorbent fibers.

17. A method for metering fibers utilizing the device of claim 1 wherein at least a portion of the fibers are superabsorbent fibers and wherein the fibers are formed into a column, metered from the column, and then conveyed to a location from which the fibers are transported away.

18. A method for metering fibers utilizing the device of claim 12 wherein at least a portion of the fibers are superabsorbent fibers and wherein the fibers are formed into a column, metered from the column, and then conveyed to a location from which the fibers are transported away.

19. A method for metering fibers utilizing the device of claim 13 wherein at least a portion of the fibers are superabsorbent and wherein the fibers are formed into a column, metered from the column, and then conveyed to a location from which the fibers are transported away.

* * * * *